United States Patent [19]

McCormick

[11] Patent Number: 4,790,782

[45] Date of Patent: Dec. 13, 1988

[54] BALANCED MARINE SURFACING DRIVE

[75] Inventor: Daniel F. McCormick, Oshkosh, Wis.

[73] Assignee: Brunswick Corporation, Skokie, Ill.

[21] Appl. No.: 160,834

[22] Filed: Feb. 26, 1988

[51] Int. Cl.[4] ..... B63H 21/26

[52] U.S. Cl. ..... 440/61; 440/75; 440/81; 416/128

[58] Field of Search ..... 440/49, 53, 55, 56, 440/57, 59, 60, 61, 62, 63, 65, 66, 75, 79, 80, 81, 82; 416/128, 129 A

[56] References Cited

U.S. PATENT DOCUMENTS

| | | | |
|---|---|---|---|
| 479,008 | 7/1892 | Lowe | 416/129 A |
| 2,337,376 | 12/1943 | Micelis | 440/81 |
| 3,057,320 | 10/1962 | Daniels | 440/112 |
| 3,430,603 | 3/1969 | Parish | 440/63 |
| 3,933,116 | 1/1976 | Adams et al. | 440/112 |
| 4,529,387 | 7/1985 | Brandt | 440/66 |
| 4,544,362 | 10/1985 | Arneson | 440/112 |
| 4,565,532 | 1/1986 | Connor | 440/75 |
| 4,600,395 | 7/1986 | Pichl | 440/61 |
| 4,619,584 | 10/1986 | Brandt | 416/129 |

*Primary Examiner*—Joseph F. Peters, Jr.
*Assistant Examiner*—Jesûs D. Sotelo
*Attorney, Agent, or Firm*—Andrus, Sceales, Starke & Sawall

[57] ABSTRACT

A marine stern drive for a boat (3) includes a propeller assembly (36) having a carrier (13) for a pair of concentric drive shafts (12, 19) to which are mounted a pair of closely adjacent fore and aft coaxial surface piercing propellers (21, 22) mounted on a common axis. The carrier also includes a downwardly extending skeg (31). The shafts are connected to a source of power (5) and drive the propellers in contra-rotating relationship at essentially equal rotational velocities. The carrier is connected to devices (39–41) for swinging the carrier laterally for steering, and also vertically. A control (45) is provided for positioning and maintaining the carrier vertically such that both contra-rotating propellers are continuously disposed in surface piercing position during normal operation of the drive. The result is that lateral forces created on the propeller carrier by one rotating surface piercing propeller are counterbalanced by the other propeller when the skeg is parallel to the boat centerline (4). The leading edges (32, 33) of both propellers are relatively sharp for surface piercing, while the training edges (33, 34) of both propellers are relatively blunt.

5 Claims, 2 Drawing Sheets

FIG. 1
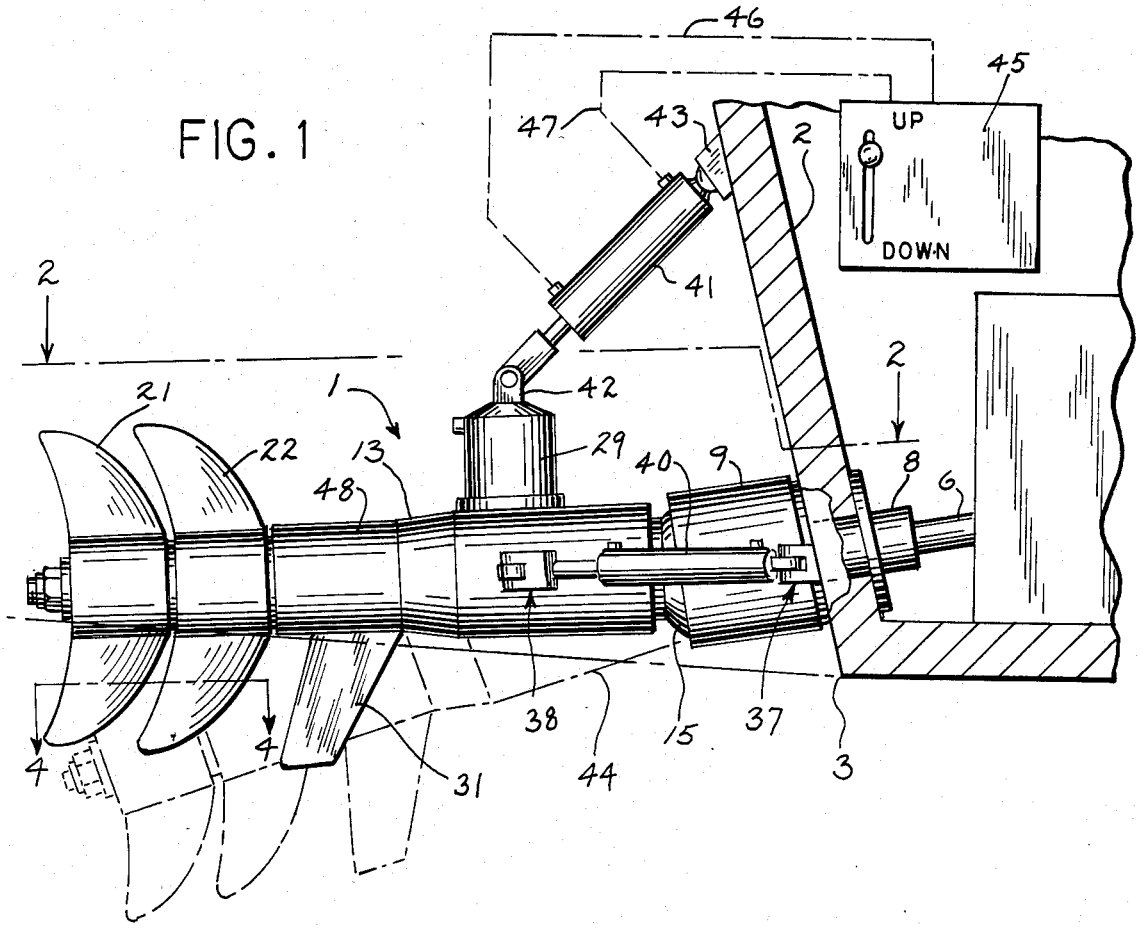
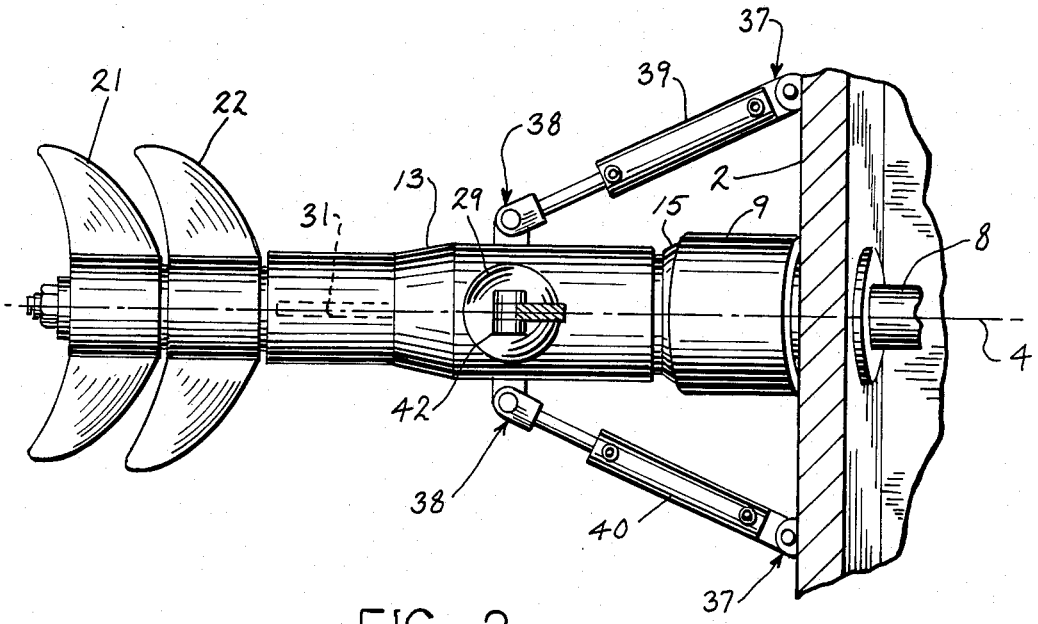
FIG. 2

BALANCED MARINE SURFACING DRIVE

BACKGROUND AND SUMMARY OF THE INVENTION

This invention relates to marine drives, and more particularly to a drive incorporating the concept of maintaining the drive propeller in a position so that it pierces the surface of the water during normal operating conditions. Such so-called surfacing drives are often used in high speed competition, and it is important that they provide maximum output with minimum drag.

Generally, a marine surfacing drive can be defined as a drive wherein at least one blade of a propeller is disposed above the water surface at design conditions, i.e., high speed. Such a drive can also be defined as a drive in which the propeller centerline is generally adjacent or above the water surface, again at design conditions.

Examples of known marine surfacing drives are disclosed in U.S. Pat. Nos. 3,933,116, 4,544,362 and 4,565,532. The constructions disclosed in these patents incorporate a single propeller carried by a single propeller drive shaft. U.S. Pat. No. 4,544,362 additionally discloses an embodiment in FIG. 11 thereof of a pair of separate engines driving a pair of laterally spaced separate surface piercing propellers mounted on separate drive shafts. Other U.S. patents of general interest in this regard are U.S. Pat. Nos. 3,057,320 and 3,430,603, although the units described therein are apparently not intended for normal continuous driving in surfacing mode.

Most marine stern drives, to which the present invention is basically directed, include a propeller carrier from which downwardly depends a stabilizing fin or skeg just forwardly of the propeller itself. The skeg is designed to be parallel to the boat centerline during straight forward travel. See, for example, the member 90 in the aforementioned U.S. Pat. No. 4,544,362.

Problems have been observed with the known single propeller surfacing drives. Because the upper portion of the propeller is out of the water, the propeller creates a strong lateral force on the propeller carrier. To keep the boat on a straight forward course, this lateral force must be countered by steering the propeller carrier so that the skeg is turned so that it assumes an angular, rather than parallel, position with respect to the boat centerline. The result is the creation of undesirable high drag forces as the angular skeg is pushed through the water and propeller thrust is directed at an angle to the boat path.

Further, if the surface piercing propeller bounces in and out of the water due to wave conditions or trim attitude, radical and destabilizing steering forces can result. A large skeg may help to alleviate this problem, but again at the cost of high drag.

In addition, the imbalance in steering caused by the angularly adjusted skeg results in making the boat easy to turn in one direction, but very difficult to turn in the opposite direction.

Due to the aforesaid difficulties, many applications of high speed surfacing drives have required dual engines, dual propeller drive shafts, and laterally disposed dual oppositely rotating propellers, in an attempt to overcome the problems. However, the high cost and weight of dual systems has made them less than practical.

It is an object of the present invention to essentially eliminate the unbalanced lateral forces on the propeller carrier, even when the drive is used in a continuously surfacing mode, and without utilizing expensive and heavy dual drives, thus allowing propeller thrust to be aligned with the boat path.

Broadly in accordance with the aspects of the invention, means are provided to maintain a balance of lateral forces on the common carrier of contra-rotating surface piercing propellers when the skeg and propeller thrust are disposed parallel to the boat centerline and the drive is in surface piercing condition.

More specifically, a marine stern drive for a boat includes a propeller assembly having a carrier for a pair of concentric drive shafts to which are mounted a pair of closely adjacent fore and aft coaxial surface piercing propellers mounted on a common axis. The carrier also includes a downwardly extending skeg. The shafts are connected to a source of power and drive the propellers in contra-rotating relationship at essentially equal rotational velocities. The carrier is connected to devices for swinging the carrier laterally, for steering, and also vertically. A control is provided for positioning and maintaining the carrier vertically such that both contra-rotating propellers are continuously disposed in surface piercing position during normal operation of the drive. The result is that lateral forces created on the propeller carrier by one rotating surface piercing propeller are counterbalanced by the other propeller when the skeg and propeller line of thrust are parallel to the boat centerline.

Another aspect of the invention provides that the leading (or fore) edges of both propellers are relatively sharp for surface piercing, while the trailing (or aft) edges of both propellers are relatively blunt. The sharp leading edge of one propeller faces the blunt trailing edge of the other. While coaxial reverse-rotating propellers are known in marine drives, such as in U.S. Pat. Nos. 4,529,387 and 4,619,584, they have previously been fully submerged in normal operation and did not create undesirable lateral forces on the propeller carrier, as has been the case with propellers which are designed to normally pierce the water surface.

BRIEF DESCRIPTION OF THE DRAWINGS

The accompanying drawings illustrate the best mode presently contemplated by the inventor for carrying out the invention.

In the drawings:

FIG. 1 is a generally schematic side elevation of a marine stern drive incorporating various aspects of the present invention, and showing a control therefor;

FIG. 2 is a top plan view of the drive, taken on line 2—2 of FIG. 1;

DESCRIPTION OF THE PREFERRED EMBODIMENT

Figure 3:
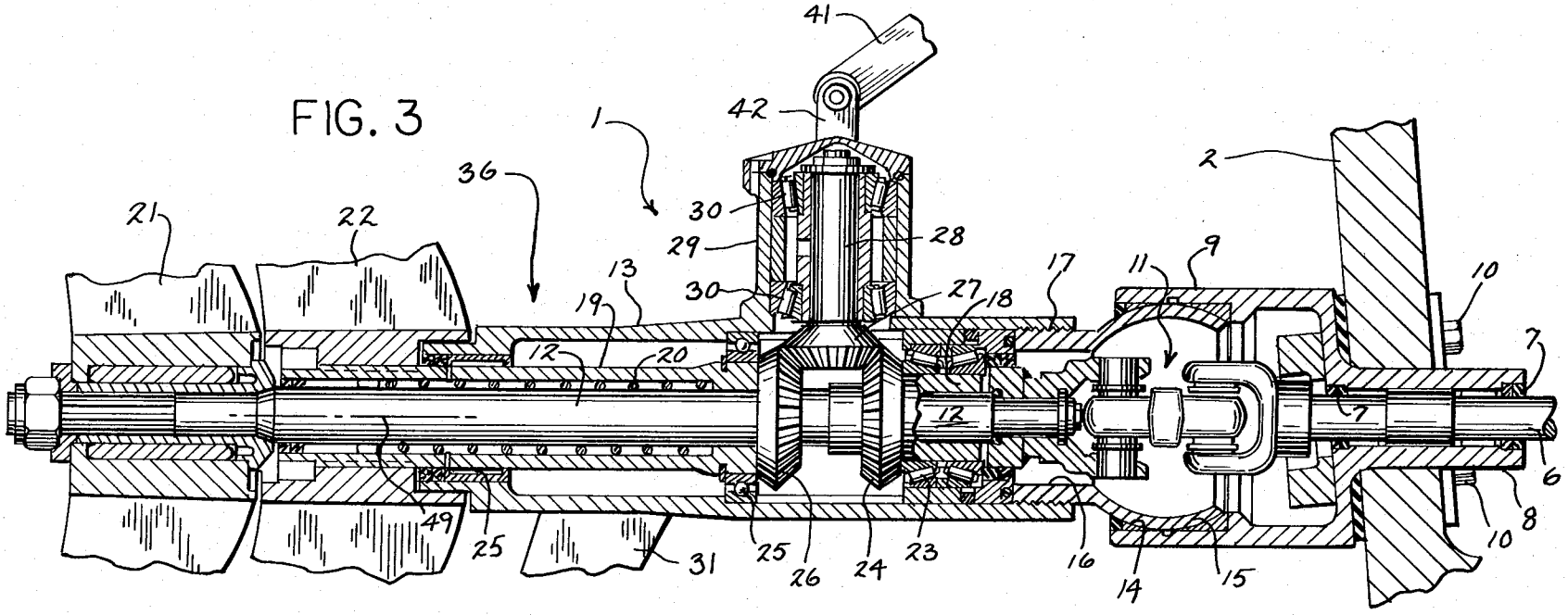
FIG. 3 is an enlarged longitudinal generally sectional view of the drive.

As shown in the drawings, the various aspects of the invention are incorporated in a marine stern drive 1 which is mounted to the transom 2 of a boat 3 having a longitudinal centerline 4, with drive 1 adapted to be powered by a single suitable engine 5.

Engine 5 is provided with an output shaft 6 which extends rearwardly through spaced bearings 7 in a tubular boss 8 which in turn extends through a suitable opening in transom 2. Boss 8 merges outwardly into a tubular support casing 9 which is secured to transom 2, as by bolts 10. A universal joint 11 of any suitable well-known type is disposed within casing 9 and connects engine output shaft 6 to a central axial longitudinal main propeller drive shaft 12.

A tubular propeller shaft housing or carrier 13 is adapted to be mounted adjacent its forward end to support casing 9. For this purpose, casing 9 is provided with a ball socket 14 which is adapted to receive a hollow ball 15 which is mounted for universal pivoting movement within the socket. Ball 15 forms the forward portion of an open ended housing 16 which is threaded, as at 17, into the forward end of carrier 13. See the aforementioned U.S. Pat. No. 4,544,362, for a generally similar construction.

Universal joint 11 is connected to a sleeve 18 which is keyed or otherwise fixedly secured to the forward end portion of main propeller drive shaft 12. A secondary propeller drive shaft 19 is of tubular construction and telescopes over main shaft 12 rearwardly of sleeve 18, and is mounted for separate rotation relative thereto. A coil spring 20 between shafts 12 and 19 assists in generating oil circulation therebetween. A first propeller 21 is suitably fixed to the outer end portion of main shaft 12 for rotation therewith, while a second propeller 22 is suitably fixed to the outer end portion of secondary shaft 19.

Propellers 21 and 22 are of the surface piercing type and are basically mirror images of each other, and are adapted to be driven at essentially equal rotational velocities and in a contra-rotating manner. For this purpose, and in the embodiment shown, sleeve 18 is journalled in annular bearings 23 within carrier 13 and is provided with an input side bevel gear 24 fixed thereon. Likewise, secondary shaft 19 is also journalled in bearings 25 within carrier 13 and is provided with an output side bevel gear 26 fixed thereon and spaced from gear 24.

Means are provided to drivingly join bevel gears 24 and 26 to provide the ultimate contra-rotating propeller drive. For this purpose, and in the present embodiment, a pinion gear 27 is suitably affixed to the inner end of a pinion or jack shaft 28 which extends radially outwardly through the wall of carrier 13, with gear 27 meshingly joining bevel gears 24 and 26. Jack shaft 28 is disposed within a housing 29 and is supported for rotation on bearings 30. Other forms of drive-splitting may be utilized without departing from the spirit of the invention.

As shown in FIGS. 1 and 2, a stabilizing fin or skeg 31 extends downwardly from the body of propeller shaft carrier 13, is generally planar. During normal operation of drive 1, when boat 3 is traveling straight ahead, skeg 31 is disposed in parallelism with boat centerline 4. See FIG. 2.

Figure 4:
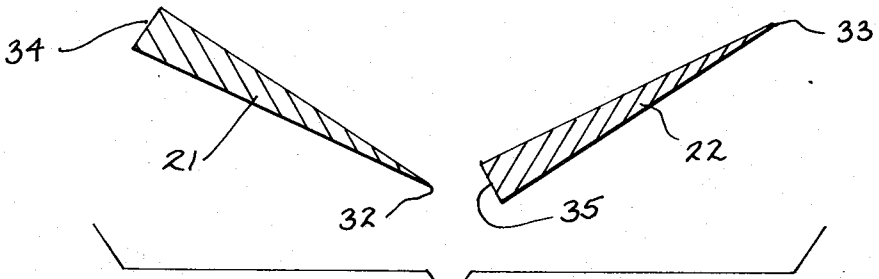
FIG. 4 is an enlarged section of the propellers taken on line 4—4 of FIG. 1.

As best seen in FIG. 4, the contra-rotating propellers 21 and 22 each have a body which may be generally wedge-shaped, with the forward or leading edge of each propeller being relatively sharp, as at 32,33 respectively. Likewise, the aft or trailing edges of each propeller are relatively blunt, as at 34,35 rspectively. Thus, forward sharp edge 32 of aft propeller 21 is disposed closely adjacent and facing the blunt trailing edge 35 of forward propeller 22.

Some of the elements described above form a propeller assembly 36. These elements include prop shaft carrier 13, drive shafts 12 and 19, propellers 21,22, and skeg 31.

Means are provided for selectively shifting carrier 13 laterally for steering boat 3, and for providing for vertical movement of the carrier to trim the boat. For this purpose, mounting brackets 37 are provided on the stern of the boat, while opposed ears 38 extend laterally outwardly from the side of carrier 13 aft of brackets 37. A pair of opposed steering cylinders 39 and 40 are mounted between mounting brackets 37 and respective ears 38, and are connected to any suitable steering control, such as a steering wheel, not shown. The control may be hydraulic or of any other suitable nature.

In addition, a trim cylinder 41 is connected between ears 42 mounted on the outer end of jack shaft housing 29 and a suitable bracket 43 mounted on transom 2. In this instance, a control system is schematically illustrated in FIG. 1 for selectively raising, lowering or setting the position of trim cylinder 41, and thus the angular position of propeller assembly 36, relative to the surface 44 of the water. The control system 45 shown is connected through a hydraulic or other system, via lines 46,47 to trim cylinder 41.

Propeller assembly 36 will be hydraulically fixed in any position selected by the operator.

By providing coaxial contra-rotating surface piercing propellers, the undesirable lateral forces on the common axis 49 of propellers 21, 22, and thus on carrier 13 and boat 3, will be balanced on this same single axis during surfacing drive mode and when skeg 31 and the propeller line of thrust are parallel to boat centerline 4, thus essentially eliminating the aforementioned steering imbalances and loss of efficiency.

Various modes of carrying out the invention are contemplated as being within the scope of the following claims, which particularly point out and distinctly claim the subject matter of the invention.

I claim:

1. A marine surfacing drive for attachment to a boat (3) having a longitudinal centerline (4), said drive comprising, in combination:

(a) a longitudinal propeller drive assembly (36) including a propeller carrier (13) defining a drive axis (49), (b) means (9, 14, 15) for pivotally mounting said carrier on the boat, (c) steering means (39, 40) for selectively pivoting said carrier laterally relative to the boat centerline, (d) means (41) for vertically pivoting said carrier relative to the water surface, (e) control means (45) for said last-named means (41) to position said carrier so that at least a portion of said drive assembly is normally disposed in water surface piercing position, (f) balancing means on said drive assembly to maintain the lateral forces on both sides of said carrier in balance when said drive axis is disposed parallel to the boat centerline and when a portion of said assembly is in surface piercing position during driving the boat in a straight course through the water, (g) said drive assembly (36) including:

(1) a pair of adjacent water surface piercing propellers (21, 22) disposed at the rearwward end of said carrier (13), said propellers being coaxial on said drive axis (49), (2) and means for driving said propellers from a single boat mounted engine and in contrarotating relationship, (h) and said propellers, when contra rotating and in surface piercing position, forming said balancing means wherein a said lateral force created by one propeller on said carrier is balanced by an opposite lateral force created by the other propeller.

2. The marine surfacing drive of claim 1 wherein: each said water surface piercing propeller (21, 22) comprises a generally wedge-shaped body having a relatively sharp leading edge (32, 33) and a relatively blunt trailing edge (34, 35).

3. The marine surfacing drive of claim 2 wherein:

(a) said propellers (21, 22) are disposed in forward and rearward relationship, (b) and the leading relatively sharp edge (32) of the said rearward propeller (21) is disposed closely adjacent and facing the trailing relatively blunt edge (35) of the said forward propeller.

4. In a marine surfacing drive for attachment to a boat (3), the combination comprising:

(a) a longitudinal propeller carrier (13) defining a drive axis (49), (b) means for mounting said carrier on the boat for lateral and vertical pivoting relative thereto, (c) a pair of adjacent water surface piercing propellers (21, 22) disposed coaxially at the rearward end of said carrier, (d) and means for driving said propellers from a single boat mounted engine and in contrarotating relationship, (e) each said propeller comprising a generally wedge-shaped body having a relatively sharp leading edge (32, 33) and a relatively blunt trailing edge (34, 35).

5. The marine surfacing drive of claim 4 wherein:

(a) said propellers (21, 22) are disposed in forward and rearward relationship, (b) and the leading relatively sharp edge (32) of the said rearward propeller (21) is disposed closely adjacent and facing the trailing relatively blunt edge (35) of the said forward propeller.

* * * * *